US005876849A

United States Patent [19]

Green

[11] Patent Number: 5,876,849

[45] Date of Patent: Mar. 2, 1999

[54] COTTON/NYLON FIBER BLENDS SUITABLE FOR DURABLE LIGHT SHADE FABRICS CONTAINING CARBON DOPED ANTISTATIC FIBERS

[75] Inventor: James Green, Bonita Springs, Fla.

[73] Assignee: Itex, Inc., Aurora, Colo.

[21] Appl. No.: 886,892

[22] Filed: Jul. 2, 1997

[51] Int. Cl.[6] ..... D02G 3/00

[52] U.S. Cl. ..... 428/359; 428/362

[58] Field of Search ..... 428/359, 372, 428/364, 373, 374, 362

[56] References Cited

U.S. PATENT DOCUMENTS

| | | | |
|---|---|---|---|
| 2,845,962 | 8/1958 | Bulgin . | |
| 2,949,134 | 8/1960 | Hindle et al. . | |
| 3,067,779 | 12/1962 | Draper et al. . | |
| 3,803,453 | 4/1974 | Hull . | |
| 3,849,181 | 11/1974 | Green . | |
| 3,969,559 | 7/1976 | Boe . | |
| 3,971,202 | 7/1976 | Windley . | |
| 3,986,528 | 10/1976 | Green . | |
| 3,987,613 | 10/1976 | Woods et al. . | |
| 4,048,371 | 9/1977 | Brumlik . | |
| 4,061,811 | 12/1977 | Takase et al. . | |
| 4,092,194 | 5/1978 | Green . | |
| 4,154,881 | 5/1979 | Hirakawa et al. . | |
| 4,207,376 | 6/1980 | Nagayasu et al. . | |
| 4,216,264 | 8/1980 | Naruse et al. . | |
| 4,232,082 | 11/1980 | Noritake . | |
| 4,248,934 | 2/1981 | Wandel et al. . | |
| 4,255,487 | 3/1981 | Sanders . | |
| 4,296,597 | 10/1981 | Tani et al. . | |
| 4,343,334 | 8/1982 | Sculze et al. . | |
| 4,388,370 | 6/1983 | Ellis et al. . | |
| 4,420,529 | 12/1983 | Westhead . | |
| 4,422,483 | 12/1983 | Zins . | |
| 4,473,617 | 9/1984 | van Leeuwen et al. | 428/373 |
| 4,557,968 | 12/1985 | Thornton et al. | 428/408 |
| 4,606,968 | 8/1986 | Thornton et al. . | |
| 4,610,905 | 9/1986 | von Blucher . | |
| 4,610,925 | 9/1986 | Bond . | |
| 4,756,969 | 7/1988 | Takeda . | |
| 4,771,596 | 9/1988 | Klein . | |
| 4,781,223 | 11/1988 | McAliley et al. . | |
| 4,813,459 | 3/1989 | Breidegam . | |
| 4,856,299 | 8/1989 | Bryant . | |
| 4,868,041 | 9/1989 | Yamagishi et al. . | |
| 4,869,951 | 9/1989 | McCulough, Jr et al. . | |
| 4,900,613 | 2/1990 | Green . | |
| 4,920,000 | 4/1990 | Green . | |
| 4,927,698 | 5/1990 | Jaco et al. . | |
| 4,941,884 | 7/1990 | Green . | |
| 4,950,533 | 8/1990 | McCullough, Jr et al. . | |
| 5,025,537 | 6/1991 | Green . | |
| 5,077,126 | 12/1991 | Green . | |
| 5,102,727 | 4/1992 | Pittman et al. . | |
| 5,103,504 | 4/1992 | Dordevic . | |
| 5,167,264 | 12/1992 | Kalin . | |
| 5,223,334 | 6/1993 | Green . | |
| 5,277,855 | 1/1994 | Blackmon et al. . | |
| 5,288,544 | 2/1994 | Mallen et al. . | |
| 5,305,593 | 4/1994 | Rodini et al. . | |
| 5,468,545 | 11/1995 | Fleming et al. | 428/920 |
| 5,478,154 | 12/1995 | Pappas et al. . | |
| 5,480,458 | 1/1996 | Fleming et al. | 427/397.3 |
| 5,482,763 | 1/1996 | Shaffer . | |
| 5,512,355 | 4/1996 | Fuson | 428/244 |
| 5,617,904 | 4/1997 | Kalin . | |
| 5,759,207 | 6/1998 | Green . | |

FOREIGN PATENT DOCUMENTS

| | | |
|---|---|---|
| 00557024A | 8/1993 | European Pat. Off. . |
| 08-296172 | 10/1996 | Japan . |

*Primary Examiner*—Newton Edwards
*Attorney, Agent, or Firm*—Terry M Gernstein

[57] ABSTRACT

Cotton/nylon fiber blends have been discovered which are suitable for use in the warp yarns of durable fabrics dyed in light shades with permanent antistatic properties.

4 Claims, No Drawings

COTTON/NYLON FIBER BLENDS SUITABLE FOR DURABLE LIGHT SHADE FABRICS CONTAINING CARBON DOPED ANTISTATIC FIBERS

DESCRIPTION

This invention relates to cotton/nylon fiber blends suitable for use in warp yarns in durable fabrics with permanent antistatic properties which can be dyed in light shades using cotton specific dyes despite the presence of black antistatic fibers. The fabrics are made from blends of cotton, nylon and thermoplastic fibers doped with carbon particles.

BACKGROUND

While 100% cotton fabrics provide excellent resistance to nuisance static created by friction rubbing at relative humidities above 45%, they generate considerable electric shocks when rubbed below 35% relative humidity. Fabrics made from blends of cotton and nylon have better durability than cotton fabrics but have antistatic properties as poor as 100% cotton fabrics at low relative humidity. It is generally known that nuisance static can be reduced to acceptable levels in cotton/nylon fabrics by adding at least 1% of thermoplastic fibers doped with carbon black to both the warp and fill yarns. However, light colored fabric cannot be produced by this method using the dyes normally used on cotton/nylon blends because of the streaks caused by the black antistatic fibers.

It would be highly desirable to be able to use carbon doped antistatic fibers in cotton/nylon blend fabrics of light shades because the antistatic properties provided in this manner are permanent and do not wash out.

SUMMARY OF THE INVENTION

This invention provides staple fiber blends suitable for warp yarns of durable fabrics having good antistatic properties at low relative humidity and uniform appearance when dyed in light shades comprising 10% to 35% nylon fibers, 0.30% to 0.70% of carbon doped thermoplastic fibers and 65% to 90% cotton fibers. Novel fabrics containing such warp yarns consist of 5% to 20% nylon fibers and 0.15% to 0.40% carbon doped thermoplastic fibers and 80% to 95% cotton fibers.

DETAILED DESCRIPTION OF THE INVENTION

The staple fibers used herein are textile fibers having a linear density suitable for wearing apparel, i.e., less than 10 decitex per fiber, preferably less than 5 decitex per fiber. Still more preferred are fibers that have a linear density of 1 to 3 decitex per fiber and length from 1.9 to 6.3 cm (0.75 to 2.5 in). Crimped fibers are particularly good for textile aesthetics and processibility.

Nylon is required instead of other reinforcement fibers such as polyester because its unusually high toughness allows the small (10% to 35% in the warp) quantities necessary for this invention to provide a substantial improvement in abrasion resistance. As shown in Table 1, U.S. Pat. No. 4,920,000, 20% polyester in the warp of cotton blend fabrics only increases the abrasion resistance 50% compared with 100% cotton fabrics, whereas 30% nylon triples the abrasion resistance. Nylon 6,6 is the preferred aliphatic polyamide but others such as 6 nylon may be used.

An exemplary antistatic fiber for use in the present invention is that made by doping a polyethylene core with carbon particles and surrounding it with a sheath of nylon such as that made by the Dupont Co. and commercially available in blends with 98/2% T420 nylon/ antistatic staple fibers. Other satisfactory fibers include carbon doped fibers made by Kanebo Co. of Japan and those described in U.S. Pat. No. 4,756,969.

The same dyes used on non antistatic cotton/nylon fabrics, e.g. vat, direct and naphthol dyes may be used even though these dyes are specifically for cotton and only the cotton is dyed and not the nylon and nylon sheath of the carbon doped fibers. This permits fabrics to achieve a greater range of colors and washfastness than would be the case if the antistatic fibers had to be hidden by dyeing the cotton, the nylon and nylon sheathed fibers.

Greige fabric construction as described herein refers to the condition of the fabric on or off the loom in an unfinished state. Generally such fabrics contain chemical size applied to the warp such as starch, as an aid to weaving. Yarn weights as described herein refer to the yarn weights prior to application of chemical size. Greige fabrics which have been rinsed and cleaned in preparation for dyeing are referred to as bleached.

The process for making the fabric involves the step of first preparing a blend comprising 65% to 90% cotton fibers, 10% to 35% aliphatic polyamide (nylon) staple fibers and 0.30% to 0.70% thermoplastic fibers doped with carbon. Yarn is spun from the blend and fabric is woven using these yarns as the warp and 100% cotton yarns as the fill.

It is important to maintain the proper content of the three fiber types to achieve the desired results. Too much carbon doped fiber will cause streaks in light colored fabrics and too little results in loss of antistatic protection. If the fabric contains more than 35% nylon fibers in the warp, excessive antistatic fibers will be required which will cause streaks, too little will result in no improvement in wear life compared with 100% cotton fabrics. The fill must be made from 100% cotton in order to limit the amount of antitatic fibers required in the fabric.

It is surprising that fabrics containing antistatic fibers only in the warp and at a level not visible in light colored fabrics made with dyes specific for cotton can provide antistatic protection since the 100% cotton yarns like those in the fill are known to produce a large charge build up when rubbed at low relative humidity. This is why antistatic fibers had been previously thought to be required in both the warp and fill.

As shown in Examples 1,2 and Table 1 below, antistatic protection was achieved in cotton/nylon blend fabrics with as little as 0.5% carbon doped thermoplastic fibers in the warp and with 100% cotton fill. When Example 2 was dyed to a light khaki color using vat dyes it had a highly uniform appearance with no objectional streaks. As shown in Table 1, comparative fabrics A,B which are similar to Examples 1,2 respectively, except for the absence of carbon doped fibers, exhibited high charge build up as measured by static cling. Comparative Example C was similar to Example 2 except that it was made of 100% cotton and contained no antistatic fibers. Cling Time of Example C was greater than 360 sec. which illustrates the ability of 100% cotton fabrics to hold a strong charge for a long time at low relative humidity.

Fabric content of carbon doped fibers in Examples 1,2 was only 0.25% of fabric weight while 1% was found to be required for comparative Example D having 50% nylon in both directions as shown in Table 1. When Example D was dyed a light khaki shade with direct dye, numerous objectionable streaks due to the antistatic fibers were obtained. This illustrates the novelty of keeping the antistatic fiber well below that generally thought to be required (e.g. ¼) while still providing antistatic protection and high durability.

During processing of the fabrics of the invention durable press resins may be applied to the fabric. Many other conventional fabric treatments may also be carried out on the fabrics such as flame retarding, mercerization, application of dyes, hand builders and softeners and framing.

The antistatic fabrics described in this invention can be flame retarded by methods such as that decribed in U.S. Pat. Nos. 5,480,458, and 5,468,545 which describe nylon/cotton blend fabrics treated with a flame retardant which lasts the life of the garment. U.S. Pat. No. 4,909,805 describes a two step process for applying flame retardant to blends of cotton and nylon fibers. This and other flame-retardant treatment technology such as U.S. Pat. No. 5,571,228 can be applied to antistatic fabrics of this invention without losing the antistatic protection.

STATIC CLING TEST

All measurements are preceded by washing fabrics with hot water and detergent with no softner in a home laundry machine and drying in a conventional tumble drier in preparation for testing. This is repeated three times. Fabric samples are then dried for twenty minutes on a hot plate at 65 deg. C. (150 deg. F.). to reduce the moisture to less than 2%, similar to the moisture level in fabrics at less than 35% relative humidity. Fabrics are rubbed 20 times across the warp with a 100% polyester cloth over an area of 5×5" while on the hot plate. Immediately (less than 5 sec.) after the fabric is removed from the hot plate a polystyrene pith ball is placed on the rubbed area with the fabric held in a vertical position in a room with an ambient temperature between 15 to 27 deg. C. (60 to 80 deg. F.), and 45% to 65% relative humidity. The length of time in seconds that the pith ball clings to the fabric before it falls is called the Cling Time.

Fabrics which hold the pith ball less than 60 seconds have very low nuisance static at relative humidities below 35% whereas those which hold the ball 120 sec. or more will cause electrical shocks in garments worn below 35% relative humidity. Samples with a Cling Time of less than 60 seconds are considered to have passed the cling test, and can be expected to produce barely noticeable shocks at low humidity. Those greater than 120 seconds have failed and can be expected to produce significant electrical shocks. Samples with a Cling Time between 60 and 120 seconds are borderline and may produce small shocks at very low humidity.

EXAMPLE 1

A 3×1 left hand twill fabric was made having in the warp 24.5 wt % of polyhexamethylene adipamide (6,6 nylon) fibers having a linear density of 2.77 dtex (2.5 dpf) and a length of 3.8 cm (1.5 in) and 0.5% carbon doped thermoplastic fibers (available as 98% T-420 nylon/ 2% antistatic fiber blend from Dupont) and 75% cotton. Warp yarn linear density was 29 tex (20 1/cc). The fill was made from 100% cotton yarns with a linear density of 47 tex (12.7 1/cc). The fabric had a nylon content of about 12% and cotton content was 88%. The fabric in the greige condition on the loom had 84 warp ends and 46 ends in the fill. After the fabric was bleached it had a Cling Time of 40 seconds.

Comparative examples A not of the invention and described in Table 1 was made similar to Example 1 but the fabric contained no antstatic fiber and was bleached and dyed. Cling Time was greater than 360 seconds.

EXAMPLE 2

A 4×1 sateen fabric was made having in the warp 24.5 wt % of polyhexamethylene adipamide (6,6 nylon) fibers having a linear density of 2.77 dtex (2.5 dpf) and a length of 3.8 cm (1.5 in) and 0.5% carbon doped thermoplastic fibers (available as T-420 nylon/ 2% antistatic fiber blend from Dupont) and 75% cotton. Warp yarn linear density was 45 tex (13 1/cc). The fill was made from 100% cotton yarns with a linear density of 59 tex (10 1/cc). The fabric had a nylon content of about 12% and cotton content was 88%. The fabric in the greige condition on the loom had 75 warp ends and 62 ends in the fill. After the fabric was bleached the Cling Time was 40 seconds. After dyeing a light khaki color with vat dye the fabric exhibited no objectionable streaks due to the presence of the carbon doped fibers.

Comparative example B not of the invention and described in Table 1 was made similar to Example 2 but the fabric contained no antistatic fiber and was bleached, dyed and flame retarded. Cling Time was 360 seconds. Comparative Example C not of the invention was similar to Example 2 and B except that it was made of 100% cotton yarns in the warp and fill and contained no antistatic fibers. It had a Cling Time of greater than 360 seconds. Comparative Example D was made as a 2×1 left hand twill with 39 tex (15 1/cc) yarns comprised of 49% nylon, 1% carbon doped thermoplastic antistatic fiber from Dupont and 50% cotton in both the warp and fill with 81×56 ends x picks in the greige state. After the fabric was bleached and laundered the Cling Time was about 10 seconds. Objectionable streaks due to the antistatic fiber were seen in light shades after bleaching and dyeing a light khaki color with direct dye.

TABLE 1

ANTISTATIC CLING TEST RESULTS

| EXAMPLE | CLING TIME OF PITH BALL SEC. | | ANTI-STATIC |
|---|---|---|---|
| 1. 3X1 TWILL 75/24.5/.5% COTTON/NYLON/ CARBON DOPED FIBER IN THE WARP, 100% COTTON FILL 0.25% CARBON DOPED FIBER/FABRIC WT. | | 40 | PASS |
| A) LIKE 1 BUT DYED AND NO CARBON DOPED FIBER. | GREATER THAN | 360 | FAIL |
| 2. 4X1 SATEEN 75/24.5/.5% COTTON/NYLON/ CARBON DOPED FIBER IN THE WARP, 100% COTTON FILL 0.25% CARBON DOPED FIBER/FABRIC WT. | | 40 | PASS |
| B) LIKE EX. 2 BUT DYED AND FR TREATED AND NO CARBON DOPED FIBER. | | 360 | FAIL |
| C) LIKE EX. 2 BUT DYED AND FR TREATED, 100% COTTON IN WARP AND FILL, NO CARBON DOPED FIBER. | GREATER THAN | 360 | FAIL |
| D) 2X1 TWILL FABRIC 49/1/50% NYLON/ CARBON DOPED FIBER/ COTTON IN WARP AND FILL. 1% CARBON DOPED FIBER/FABRIC WT. | | 10 | PASS |

I claim:

1. An intimate blend of staple fibers comprising 10% to 35% nylon staple fibers, 0.30% to 0.70% carbon doped thermoplastic antistatic staple fibers and 65% to 90% cotton.

2. An intimate blend according to claim 1 wherein the antistatic staple fibers are made with a core of polyethylene doped with carbon surrounded by a nylon sheath.

3. A yarn of a staple blend comprising staple fibers including 10% to 35% by weight of nylon staple fibers, 0.30% to 0.70% by weight carbon doped thermoplastic antistatic staple fibers and 65% to 90% by weight cotton staple fibers.

4. The yarn defined in claim 3 wherein the antistatic staple fibers are made with a core of polyethylene doped with carbon surrounded by a nylon sheath.

* * * * *